US009010621B2

(12) United States Patent
Baker et al.

(10) Patent No.: US 9,010,621 B2
(45) Date of Patent: Apr. 21, 2015

(54) STACKABLE CONTAINERS WITH INTERLOCKING FEATURES

(71) Applicant: Domino's IP Holder LLC, Ann Arbor, MI (US)

(72) Inventors: Meredith Baker, Canton, MI (US); Benjamin A. Bangser, Westport, CT (US); Jason Eiseman, Northville, MI (US); Jessica Glass, Whitmore Lake, MI (US); James E. McCay, Fairfield, CT (US); Thomas VanEsley, Redford, MI (US); Phillip Worley, Sylvania, OH (US)

(73) Assignee: Domino's IP Holder LLC, Ann Arbor, MI (US)

( * ) Notice: Subject to any disclaimer, the term of this patent is extended or adjusted under 35 U.S.C. 154(b) by 0 days.

(21) Appl. No.: 14/022,946

(22) Filed: Sep. 10, 2013

(65) Prior Publication Data

US 2015/0068945 A1 Mar. 12, 2015

(51) Int. Cl.

| | |
|---|---|
| ***B65D 21/02*** | (2006.01) |
| ***B65D 5/00*** | (2006.01) |
| ***B65D 5/42*** | (2006.01) |

(52) U.S. Cl.

CPC ..... *B65D 5/0055* (2013.01); *B65D 5/427* (2013.01); *Y10S 229/906* (2013.01); *Y10S 229/915* (2013.01); *Y10S 229/918* (2013.01)

(58) Field of Classification Search

CPC ..... B65D 5/0055; B65D 5/427
USPC ..... 229/120.01, 915, 918; 220/23.6, 23.83
See application file for complete search history.

(56) References Cited

U.S. PATENT DOCUMENTS

| | | | | | |
|---|---|---|---|---|---|
| 2,843,307 | A | * | 7/1958 | Goltz | 206/509 |
| 3,163,344 | A | | 12/1964 | Tunick | |
| 3,207,414 | A | * | 9/1965 | Locke et al. | 229/918 |
| 3,552,579 | A | * | 1/1971 | Simon et al. | 229/915 |
| 4,971,242 | A | | 11/1990 | LaNicca | |
| 4,984,734 | A | | 1/1991 | Zion et al. | |
| 5,404,808 | A | | 4/1995 | Smith et al. | |
| 5,445,286 | A | | 8/1995 | Guimarin | |
| 5,482,724 | A | | 1/1996 | Morici et al. | |

(Continued)

FOREIGN PATENT DOCUMENTS

FR 2661892 A1 * 11/1991

OTHER PUBLICATIONS

U.S. Appl. No. 14/022,862, filed Sep. 10, 2013, 25 pages.

(Continued)

*Primary Examiner* — Gary Elkins
(74) *Attorney, Agent, or Firm* — Brooks Kushman P.C.

(57) ABSTRACT

A box for receiving a food item is provided, and the box is usable with an additional box that is also configured to receive a food item. The box includes a bottom portion including a bottom panel having a link feature formed therein, and a top portion hingedly connected to the bottom portion and configured to form a cover. The top portion includes a top panel having a link feature formed therein. The link feature of the bottom portion is cooperable with the additional box to link the two boxes together when the additional box is placed beneath the box, or the link feature of the top portion is cooperable with the additional box to link the two boxes together when the additional box is placed on top of the box. Furthermore, at least one of the link features comprises a bendable tab.

18 Claims, 6 Drawing Sheets

(56) References Cited

U.S. PATENT DOCUMENTS

| | | | | |
|---|---|---|---|---|
| 5,549,241 | A | 8/1996 | Correll | |
| 5,702,054 | A * | 12/1997 | Philips et al. | 229/906 |
| 6,234,385 | B1 * | 5/2001 | Espinoza et al. | 229/915 |
| 6,299,059 | B1 * | 10/2001 | Bernstein | 229/902 |
| 6,601,758 | B2 | 8/2003 | Lizzio | |
| 6,675,970 | B1 * | 1/2004 | Nemoto | 229/918 |
| 6,748,722 | B2 | 6/2004 | Correll | |
| 6,752,311 | B2 | 6/2004 | Tulkoff | |
| 7,261,231 | B2 | 8/2007 | Kuhn et al. | |
| 7,628,311 | B2 | 12/2009 | Kuhn et al. | |
| 2003/0098256 | A1 * | 5/2003 | Lu | 206/511 |
| 2005/0199687 | A1 | 9/2005 | Angelopoulos et al. | |
| 2007/0228132 | A1 * | 10/2007 | Philips et al. | 229/915 |
| 2013/0213842 | A1 * | 8/2013 | Rentzel et al. | 229/120.01 |

OTHER PUBLICATIONS

U.S. Appl. No. 14/168,428, filed Jan. 30, 2014, 31 pages.

* cited by examiner

STACKABLE CONTAINERS WITH INTERLOCKING FEATURES

TECHNICAL FIELD

The disclosure relates to containers for receiving food items.

BACKGROUND

Various container configurations for receiving food items, such as hot pizza, are known. Example containers are shown in U.S. Pat. Nos. 4,971,242; 4,984,734; and 5,549,241.

SUMMARY

According to one embodiment of the present disclosure, a box for receiving a food item is provided, and the box is usable with an additional box that is also configured to receive a food item. The box includes a bottom portion including a bottom panel having a link feature formed therein, and a top portion hingedly connected to the bottom portion and configured to form a cover. The top portion includes a top panel having a link feature formed therein. The link feature of the bottom portion is cooperable with the additional box to link the two boxes together when the additional box is placed beneath the box, or the link feature of the top portion is cooperable with the additional box to link the two boxes together when the additional box is placed on top of the box. Furthermore, at least one of the link features comprises a bendable tab.

According to another aspect of the present disclosure, stackable boxes for receiving food items are provided. The stackable include first and second boxes that each have a bottom portion and a top portion hingedly connected to the bottom portion and configured to form a cover. Each bottom portion includes a bottom panel having a link feature formed therein, and each top portion includes a top panel having a link feature formed therein. The link feature of the bottom portion of the first box is cooperable with the link feature of the top portion of the second box to link the boxes together when the first box is placed on top of the second box. Likewise, the link feature of the top portion of the first box is cooperable with the link feature of the bottom portion of the second box to link the boxes together when the second box is placed on top of the first box. Furthermore, at least one of the link features includes a bendable tab.

A foldable, one-piece blank, according to the disclosure, for forming a container that is usable with an additional container is also provided. The blank includes a first portion for forming a bottom portion of the container, and the first portion includes a bottom panel having a link feature. The blank further includes a second portion hingedly connected to the first portion for forming a top portion of the container, and the second portion includes a top panel having a link feature. When the blank is folded to form the container, the link feature of the second portion is cooperable with the additional container to link the two containers together when the additional container is placed on top of the container, or the link feature of the first portion is cooperable with the additional container to link the two containers together when the additional container is placed beneath the container. Furthermore, at least one of the link features comprises a bendable tab.

While exemplary embodiments are illustrated and disclosed, such disclosure should not be construed to limit the claims. It is anticipated that various modifications and alternative designs may be made without departing from the scope of the invention.

DETAILED DESCRIPTION

As required, detailed embodiments are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
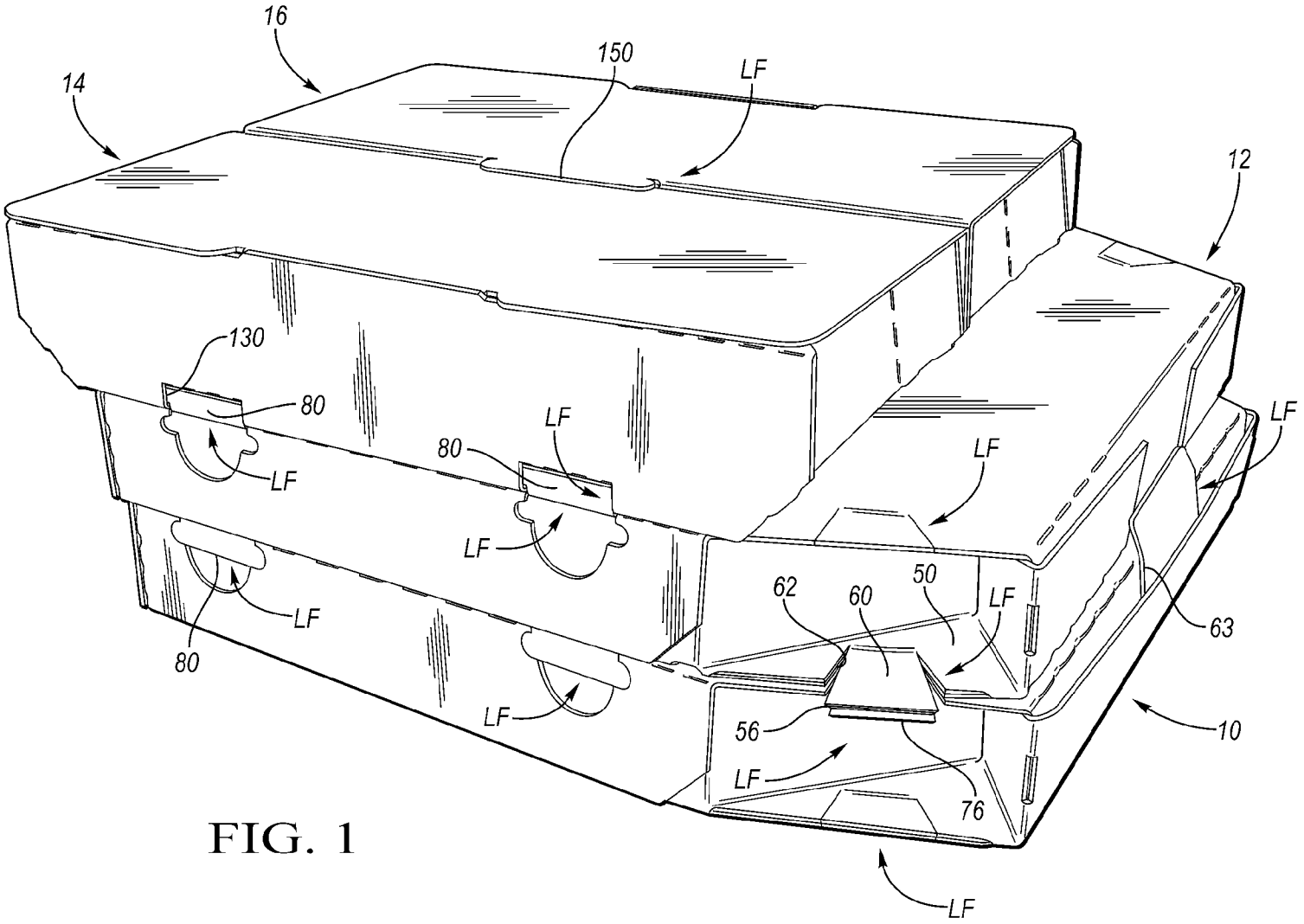
FIG. 1 is a perspective view of multiple containers, according to the disclosure, stacked on top of each other and linked together, wherein the containers include first and second pizza boxes and first and second side-order boxes.

FIG. 1 shows multiple stackable, interlocking containers for receiving food items, such as hot pizza, hot chicken wings, hot bread, etc. The containers include a first pizza box 10, a second pizza box 12 placed on top of the first pizza box 10, and first and second side-order boxes 14 and 16, respectively, placed on top of the second pizza box 12. The boxes 10, 12, 14 and 16 may each be provided with one or more link features LF, such as tabs and/or apertures, for interlocking or otherwise linking the boxes together, as explained below in detail. Such link features may facilitate transporting multiple boxes at one time.

While each of the boxes 10, 12, 14 and 16 may be made of any suitable material and in any suitable manner, in the embodiments shown in FIGS. 2-8, the boxes are each made of a die-cut, one-piece blank of corrugated paperboard material, e.g., cardboard, that is foldable to form the particular box.

Figure 2:
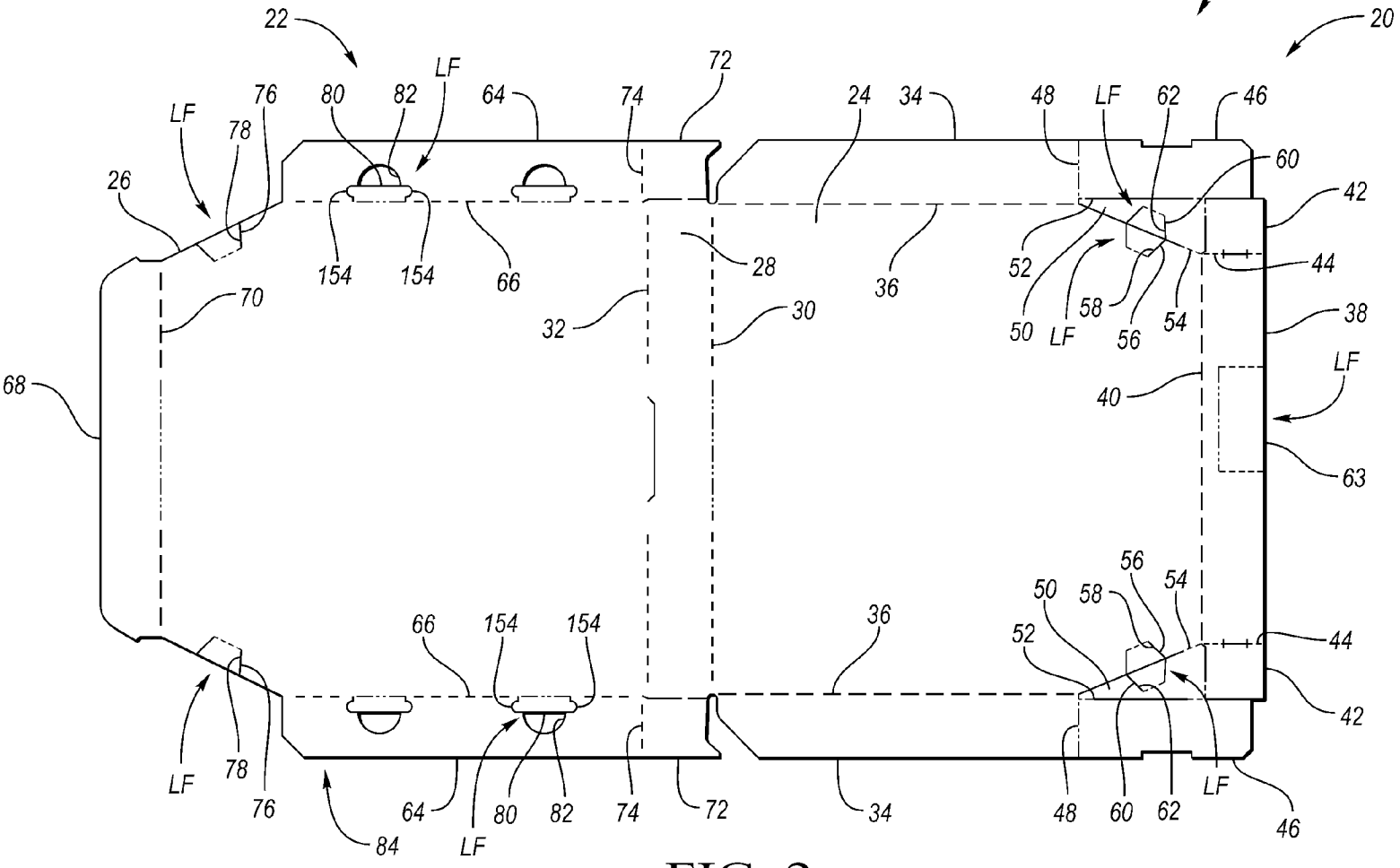
FIG. 2 is a plan view of a blank that may be used to form one of the pizza boxes, such as the first pizza box.

Referring to FIG. 2, for example, a one-piece blank 18 that is foldable to form the first pizza box 10 is shown. The blank 18 includes a first portion 20 for forming a bottom portion of the first pizza box 10, and a second portion 22 hingedly connected to the first portion 20 for forming a top portion of the first pizza box 10. In the illustrated embodiment, the first portion 20 includes a planar bottom panel 24 that is hingedly connected to a planar top panel 26 of the second portion 22 by an intermediate rear side wall panel or rear side panel 28, which may be considered part of the first portion 20 or the second portion 22. In that regard, the rear side panel 28 is foldably connected to the bottom panel 24 at a first fold line 30, and is further foldably connected to the top panel 26 at a second fold line 32. The term "fold line" as used herein may mean, for example, a line or section including a creased section, perforated section, and/or partially cut section that facilitates folding of one box portion with respect to another box portion.

For the bottom portion or first portion 20, the blank 18 further includes two side wall panels or side panels 34 that are each foldably connected to the bottom panel 24 along a respective fold line 36, a front side wall panel or front side panel 38 foldably connected to the bottom panel 24 along another fold line 40, and two front wall flaps of front flaps 42 that are each foldably connected to the front side panel 38 at a respective fold line 44. The blank 18 also includes two forward side wall panels or forward side panels 46 that are each foldably connected to a respective side panel 34 at a respective fold line 48, and two bottom panel sections 50 that are each foldably connected to a respective forward side panel 46 at a respective fold line 52. Each bottom panel section 50 is also foldably connected to the bottom panel 20 at a respective fold line 54.

In the embodiment shown in FIG. 2, the bottom panel 20 includes two link features LF formed therein at forward angled edges of the bottom panel 20, and each link feature comprises a bendable tab 56 (e.g., a tab that is bendable or movable with respect to another portion of the blank that is connected to the tab) and corresponding aperture 58. Likewise, each bottom panel section 50 includes a link feature LF formed therein, and each of those link features comprises a bendable tab 60 and corresponding aperture 62 that are cooperable with a respective bendable tab 56 and corresponding aperture 58 of the bottom panel 20, as explained below in detail. Each of the above tabs 56 and 60 and corresponding apertures 58 and 62 may be formed by cutting the respective bottom panel 20 or bottom panel section 50 such that each tab 56 and 60 has a free end and an attached end, and the apertures 58 and 62 may be revealed or become visible when the tabs 56 and 60 are bent. In addition, the front panel 38 has a link feature LF formed therein (e.g., formed by perforating or otherwise cutting the front panel 38), and that link feature also comprises a bendable tab 63.

For the top portion or second portion 22, the blank 18 further includes two side wall panels or side panels 64 that are each foldably connected to the top panel 26 along a respective fold line 66, and a front side wall panel or front side panel 68 foldably connected to the top panel 26 along an additional fold line 70. Two corner wall flaps or corner panels 72 are each foldably attached to a respective side panel 64 along a respective fold line 74.

In the embodiment shown in FIG. 2, the top panel 26 includes two link features LF formed therein (e.g., formed by cutting the top panel 26) at forward angled edges of the top panel 26, and each link feature comprises a bendable tab 76 and corresponding aperture 78. Furthermore, each side panel 64 includes one or more link features LF formed therein (e.g., formed by cutting each side panel 64), and each of those link features comprises a bendable tab 80 that is received in a corresponding opening 82. Specifically, in the embodiment shown in FIG. 2, each side panel 64 includes a generally flat or planar main portion having two openings 82 that each receive a tab 80, and each tab 80 is bendable with respect to the main portion from a first or inoperative position, in which the tab 80 is generally coplanar with the main portion, to a second or operative position, as explained below in detail. Furthermore, for each side panel 64, the main portion is connected to the top panel 26 along a first portion of the corresponding fold line 66, and each tab 80 is connected to the top panel 26 along a second portion of the corresponding fold line 66 that is coincident with the first portion of the fold line 66.

Figure 4:
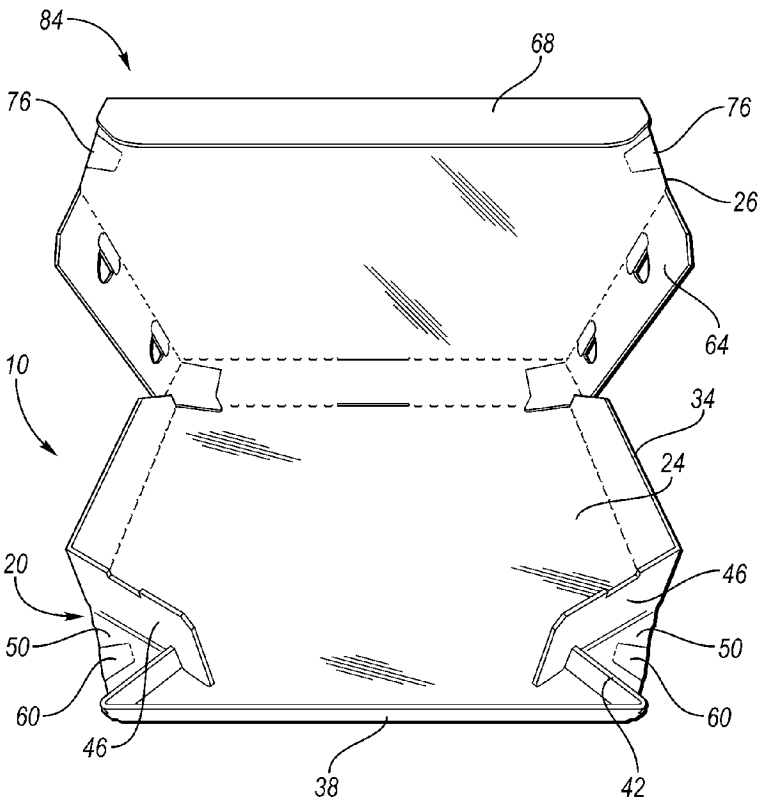
FIG. 4 is a perspective view of the first pizza box showing the cover in an open position.
Figure 3:
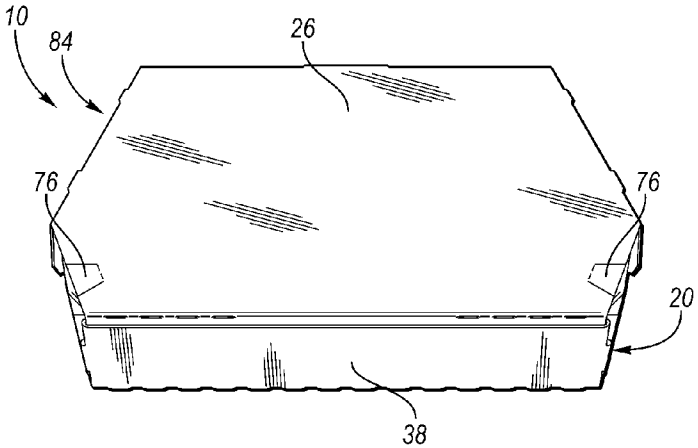
FIG. 3 is a perspective view of the first pizza box including a cover shown in a closed position.

When the blank 18 is folded (e.g., folded along fold lines) to form the first pizza box 10, the top panel 26 and the corresponding side panels 64 and front panel 68 cooperate to form a single top cover 84 that is movable with respect to the bottom portion 20 between a closed position, shown in FIG. 3, and an open position, shown in FIG. 4. In the closed position, the top panel 26 is generally parallel with the bottom panel 24. Furthermore, the bottom panel sections 50 are foldable over the bottom panel 24 so that the bottom portion 20 has a two layer thickness at front areas or forward portions of the bottom portion 20. Referring to FIGS. 1, 2 and 4, the tab 60 and corresponding aperture 62 of each bottom panel section 50 are positioned proximate a respective tab 56 and corresponding aperture 58 of the bottom panel 24 when the bottom panel section 50 is positioned on top of the bottom panel 24. In the embodiment shown in FIGS. 1 and 4, for example, the tab 60 and corresponding aperture 62 of each bottom panel section 50 are positioned directly on top of and are vertically aligned with a respective tab 56 and corresponding aperture 58 of the bottom panel 24 when the bottom panel section 50 is positioned on top of the bottom panel 24. In addition, the tabs 56 and 60 at each forward portion of the first pizza box 10 are generally vertically aligned with a respective tab 76 of the top portion 22 when the cover 84 is in the closed position.

The second pizza box 12 may have the same or similar configuration as described above with respect to the first pizza box 10. Furthermore, the pizza boxes 10, 12 may be the same size or different sizes.

With the above configuration for the pizza boxes 10, 12, the link features LF of the two pizza boxes 10, 12 may cooperate with each other to interlock or otherwise link together the two pizza boxes 10, 12 when the link features of the pizza boxes 10, 12 are sufficiently aligned. For example, referring to FIGS. 1 and 2, the second pizza box 12 may be placed on top of the first pizza box 10 and interlocked or otherwise linked with the first pizza box 10 by bending the tabs 56 and 60 of the bottom portion 20 of the second pizza box 12 downwardly from inoperative to operative positions such that the tabs 56 and 60 displace the tabs 76 formed in the top panel 26 of the first pizza box 10 and engage the edges of the top panel 26 that define the corresponding apertures 78. Specifically, the tabs 56 and 60 located at each of the two forward portions of the second pizza box 12 may be bent downwardly such that the tabs 56 and 60 of each forward portion displace a tab 76 formed in a corresponding forward portion of the first pizza box 10, and such that the tabs 56 and 60 of each forward portion enter a corresponding aperture 78 of the first pizza box 10 and engage the edges of the top panel 26 that define the corresponding aperture 78. As another example, the tabs 76 formed in the top panel 26 of the first pizza box 10 may be bent upwardly from inoperative to operative positions such that the tabs 76 displace the tabs 56 and 60 formed in the bottom panel 26 and bottom panel section 50, respectively, of the second pizza box 12 and engage the edges of the bottom panel 26 and bottom panel section 50 that define the corresponding apertures 58 and 62. If the two pizza boxes 10, 12 are different sizes, then the link feature LF at only one forward portion of each of the first and second pizza boxes 10 and 12 may be used to link the pizza boxes together.

The tab 63 of the second pizza box 12 may also be bent downwardly so that the tab 63 extends below the bottom panel 24 of the second pizza box 12, and the tab 63 may be inserted into a slot in the first pizza box 10 to further link the pizza boxes together. For example, if sides of the tab 63 are connected to a main portion of the front side panel 38 along perforated connections, those perforated connections may be broken such that the tab 63 may be bent downwardly about a fold line between the tab 63 and the main portion of the front side panel 38. Furthermore, the slot in the first pizza box 10 may be formed between the front panel 68 and front side panel 38 of the first pizza box 10, for example, when the corresponding cover 84 is in the closed position.

Figure 5:
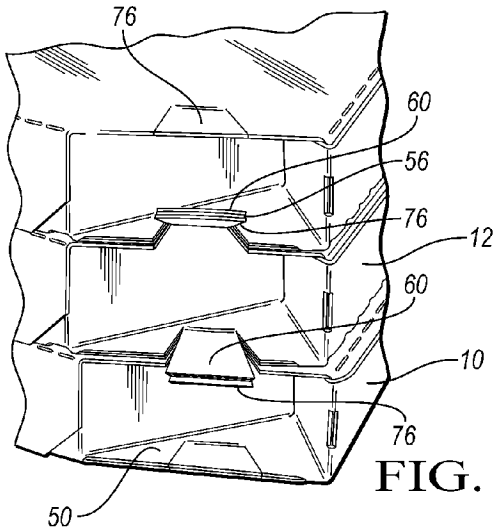
FIG. 5 is a fragmentary perspective view of three pizza boxes stacked one on top of the other.

Likewise the first pizza box 10 may be placed on top of the second pizza box 12 and interlocked or otherwise linked with the second pizza box 12 in a similar manner as described above in detail. Furthermore, any suitable number of pizza boxes that each have a similar configuration as described above may be stacked and interlocked or otherwise linked together in a similar manner. For example, three or more pizza boxes may be stacked one on top of the other and interlocked together. Referring to FIG. 5, three pizza boxes are shown stacked and interlocked together, wherein the tabs 56, 60 and 76 at the interface of the lower two pizza boxes are shown bent downwardly, and the tabs 56, 60 and 76 at the interface of the upper two boxes are shown bent upwardly.

While the tabs 56, 60 and 76 and corresponding apertures 58, 62 and 78 may each have any suitable shape, in one embodiment each tab 56, 60 and 76 may be have angled sidewalls. In the embodiments shown in FIGS. 1-5, each tab 56, 60 and 76 has a generally trapezoid shape or fish-tail shape when bent. Such a configuration may facilitate engagement of the tabs 56, 60 and 76 with box edges that define one or more apertures 58, 62 and 78.

In another embodiment, each pizza box 10, 12 may have one or more tabs formed only in one of the bottom portion 20 and top portion 22, and one or more apertures (without any corresponding tabs) formed in the other of the bottom portion 20 and top portion 22. For example, each pizza box 10, 12 may be formed with tabs 56 and 60 in the corresponding bottom portion 20, and apertures 78 formed in the corresponding top portion 22. With such a configuration, no tabs in the top portion 22 of either pizza box 10, 12 need to be displaced in order to link the boxes together. In that regard, when the second pizza box 12 is placed on top of the first pizza box 10, the tabs 56 and 60 formed in each of the two forward portions of the bottom portion 20 of the second pizza box 12 may be bent downwardly into a corresponding aperture 78 of the first pizza box 10 so that the tabs 56 and 60 at each forward portion engage edges of the top panel 26 of the first pizza box 10 that define the corresponding aperture 78. As another example, each pizza box 10, 12 may be formed with apertures 58 and 62 in the corresponding bottom portion 20, and tabs 76 formed in the corresponding top portion 22. With that configuration, when the second pizza box 12 is placed on top of the first pizza box 10, the tab 76 formed in each of the two forward portions of the top portion 22 of the first pizza box 10 may be bent upwardly so that each tab 76 engages edges of the bottom panel 24 and bottom panel section 50 of the second pizza box 12 that respectively define corresponding apertures 58 and 62.

Figure 6:
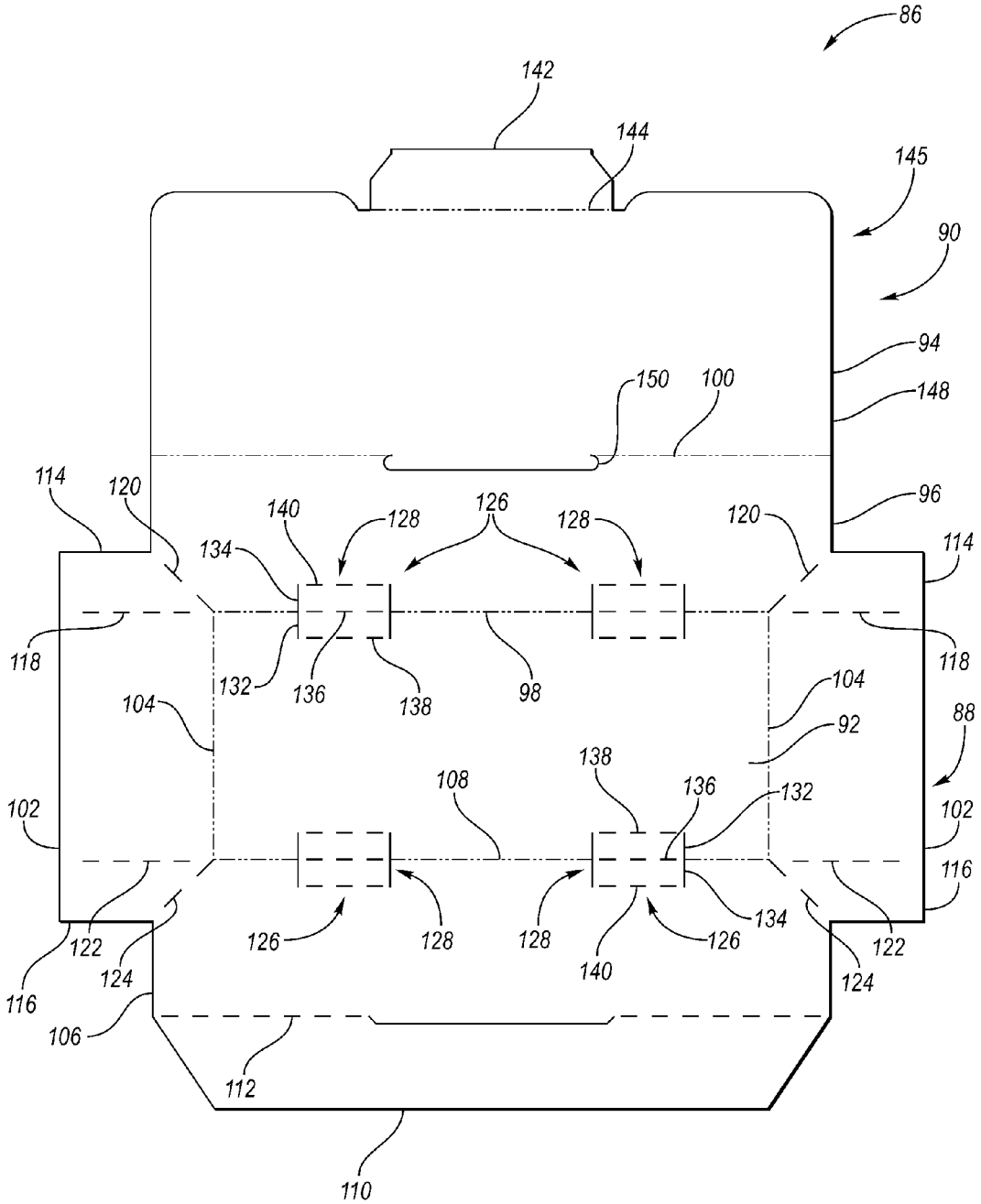
FIG. 6 is a plan view of a blank that may be used to form one of the side-order boxes, such as the first side-order box.

Referring to FIG. 6, a one-piece blank 86 for forming the first side-order box 14 is shown. The blank 86 includes a first portion 88 for forming a bottom portion of the first side-order box 14, and a second portion 90 hingedly connected to the first portion 88 for forming a top portion of the first side-order box 14. In the illustrated embodiment, the first portion 88 includes a bottom panel 92 that is hingedly connected to a top panel 94 of the second portion 90 by an intermediate rear side wall panel or rear side panel 96, which may be considered part of the first portion 88 or the second portion 90. In that regard, the rear side panel 96 is foldably connected to the bottom panel 92 at a first fold line 98, and is further foldably connected to the top panel 94 at a second fold line 100.

For the bottom portion or first portion 88, the blank 86 further includes two side wall panels or side panels 102 that are each foldably connected to the bottom panel 92 along a respective fold line 104, a front side wall panel or front side panel 106 foldably connected to the bottom panel 92 along another fold line 108, and a front flap 110 foldably connected to the front side panel 106 along yet another fold line 112. In the embodiment shown in FIG. 6, the blank 86 also includes two rear corner flaps or panels 114 and two front corner flaps or panels 116. Each rear corner panel 114 is foldably connected to a respective side panel 102 along a respective fold line 118 and to the rear side panel 96 along a respective fold line 120. Each front corner panel 116 is foldably connected to a respective side panel 102 along a respective fold line 122 and to the front side panel 96 along a respective fold line 124.

Figure 7:
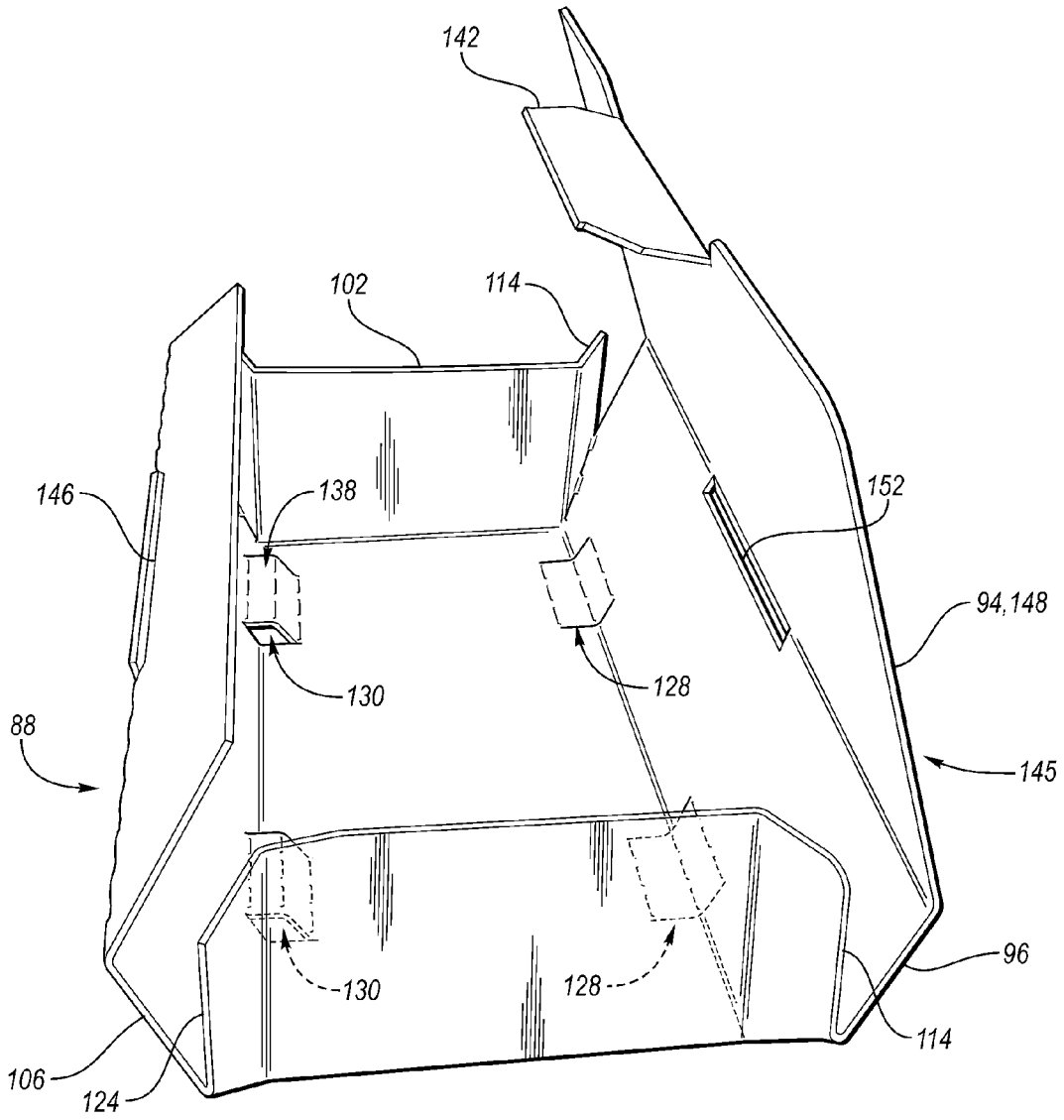
FIG. 7 is a perspective view of the first side-order box including a cover shown in an open position.

The blank 86 further has one or more link features LF, such as predefined receiving areas 126, that are each cooperable with a link feature LF of another box, such as one of the pizza boxes 10, 12, for interlocking or otherwise linking the first side-order box 14 with the other box, as explained below in detail. Each predefined receiving area 126 may be formed at least partially in the bottom panel 92 and/or one of the rear side panel 96 and front side panel 106. Referring to FIGS. 1, 6 and 7, for example, each predefined receiving area 126 may include a bendable portion 128 formed at least partially in the bottom panel 92 and one of the rear side panel 96 and front side panel 106, and the bendable portion 128 is bendable inwardly to define an opening 130 shown in FIGS. 1 and 7. Specifically, each bendable portion 128 may include first and second sections 132 and 134, respectively, that are foldably connected together along a fold line 136. Furthermore, each first section 132 may be foldably connected to a main portion of the bottom panel 92 along a first fold line 138, and each second section 134 may be foldably connected to a main portion of one of the rear side panel 96 and front side panel 106 along a second fold line 140. In the embodiment shown in FIG. 6, sides of each of the first and second sections 132 and 134, respectively, are cut so that they are not attached to either the main portion of the bottom panel 92 or the main portion of one of the rear side panel 96 and front side panel 106.

As another example, each predefined receiving area 126 may be formed without a bendable portion 128. In that regard, each predefined receiving area 126 may be formed as an aperture that is accessible when the blank 86 is folded to form the first side-order box 14.

For the top portion or second portion 90, the blank 86 further includes a tuck tab 142 foldably connected to the top panel 94 along a fold line 144. The tuck tab 142 and the top panel 94 cooperate to form a cover 145 for the first side-order box 14 when the blank 86 is folded to form the first side-order box 14. Furthermore, referring to FIGS. 1 and 7, the tuck tab 142 is receivable in a slot 146 in the first portion 88 to secure the cover 145 in a closed position (shown in FIG. 1) with respect to the bottom portion or first portion 88.

Referring to FIGS. 1, 6 and 7, the top panel 94 includes a main portion 148 and a link feature LF, such as a tab 150, extending from the main portion 148. Furthermore, when the blank 86 is folded to form the first side-order box 14, an opening 152 is formed in the rear side panel 96 when the top panel 94 is folded downwardly with respect to the rear side panel 96. The tab 150 and opening 152 are cooperable with an additional box, such as the second side-order box 16, to assist in holding the additional box against the first side-order box 14 when the additional box is placed on top of one of the pizza boxes 10, 12 and adjacent the first side-order box 14. For example, the tab 150 may engage a top surface of the additional box when the additional box is placed adjacent to the first side-order box 14. As another example, the tab 150 may be inserted into an opening of the additional box when the additional box is placed adjacent to the first side-order box 14.

The second side-order box 16 may have the same or similar configuration as the first side-order box 14. Furthermore, the side-order boxes 14 and 16 may be the same size or different sizes.

With the above configuration for the side-order boxes 14 and 16, one or both of the side-order boxes 14, 16 may be interlocked or otherwise linked with one of the pizza boxes 10, 12 when one or both of the side-order boxes 14, 16 are placed on top of one of the pizza boxes 10, 12. Specifically, referring to FIGS. 1, 2 and 6, the bendable portions 128 on one side of each side-order box 14, 16 may be pushed inwardly such that the bendable portions 128 each define an opening 130 in a respective side-order box 14, 16. Furthermore, one or both of the tabs 80 of each side panel 64 of one of the pizza boxes 10, 12, such as the second pizza box 12, may be bent upwardly and each tab 80 may be inserted into a respective opening 130 of a particular side-order box 14, 16. In that regard, each tab 80 may be bent upwardly from a first position, in which the tab 80 is generally coplanar with a respective main portion of a respective side panel 64, to a second raised or operative position for cooperating with a particular side-order box 14, 16 to interlock or otherwise link the two boxes together. In the raised position, each tab 80 extends above the top panel 26 of the second pizza box 12. Furthermore, each tab 80 may have projecting portions, such as ears 154, formed on opposite sides of the tab 80 to facilitate interlocking of the side-order boxes 14, 16 with the second pizza box 12. For example, the ears 154 of each tab 80 on one side of the second pizza box 12 may extend above the bottom panel 92 and adjacent an interior surface of the front side panel 106 or rear side panel 96 of a respective side-order box 14, 16 when the tabs 80 are inserted into the openings 130 of the side-order box 14, 16.

The openings 82 formed in the side panels 64 of the second pizza box 12 may facilitate bending of the tabs 80 to the operative positions. In that regard, each opening 82 may extend below a corresponding tab 80 to facilitate grasping of the tab 80 with a finger or suitable tool, for example.

In the embodiment shown in FIG. 1, the tabs 80 on the side of the second pizza box 12 that is not visible in the drawing are not bent upwardly and inserted into corresponding openings 130 in the second side-order box 16. Instead, the second side-order box 16 is positioned immediately adjacent the first side-order box 14 and is interlocked or otherwise linked with the first side-order box 14 by one or more link features of the side-order boxes 14, 16. For example, the tab 150 of the first side-order box 14 may be inserted into the opening 152 of the second side-order box 16, and the tab 150 of the second side-order box 16 may be engaged with the top panel 94 of the first side-order box 14. As another example, the tab 150 of the second side-order box 16 may be inserted into the opening 152 of the first side-order box 14, and the tab 150 of the first side-order box 14 may be engaged with the top panel 94 of the second side-order box 16. Each tab 150 may also have projecting portions, such as ears, formed on opposite sides of the tab 150 to facilitate interlocking of the side-order boxes 14, 16. For example, the ears of the tab 150 of one side-order box may engage, or be positioned adjacent to, an interior surface of the rear side panel 96 of the other side-order box when the tab 150 is inserted into the opening 152 of the other side-order box. The two side-order boxes 14, 16 may also be linked together in similar manners even when they are not placed on top of one of the pizza boxes 10, 12.

The configurations of the boxes 10, 12, 14 and 16 described above may provide numerous benefits or advantages. First, the above described link features may provide an efficient means to interlock or otherwise link together multiple boxes 10, 12, 14 and 16. As a result, all of the boxes for a particular order may be linked together to facilitate delivery to the customer.

Second, all of the above described link features may remain in inoperative positions when not in use. For example, the tabs 56 and 60 of the bottom portion 20 of each pizza box 10, 12 may remain generally flush with a main portion of the corresponding bottom panel 24 or bottom panel section 50, such that the tabs 56 do not project above or below the main portion of the corresponding bottom panel 24 and each tab 60 does not project above or below the main portion of the respective bottom panel section 50 when the tabs 56 and 60 are not being used to link with another box. Similarly, the tabs 76 of the top portion 22 of each pizza box 10, 12 may remain generally flush with a main portion of the respective top panel 26 such that the tabs 76 do not project above or below the main portion of the respective top panel 26 when the tabs 76 are not being used to link with another box. As a result, numerous boxes 10, 12, 14 and 16 may be premade (e.g., corresponding blanks may each be folded to form a box) and stacked on top of each other without linking the boxes together.

Figure 8:
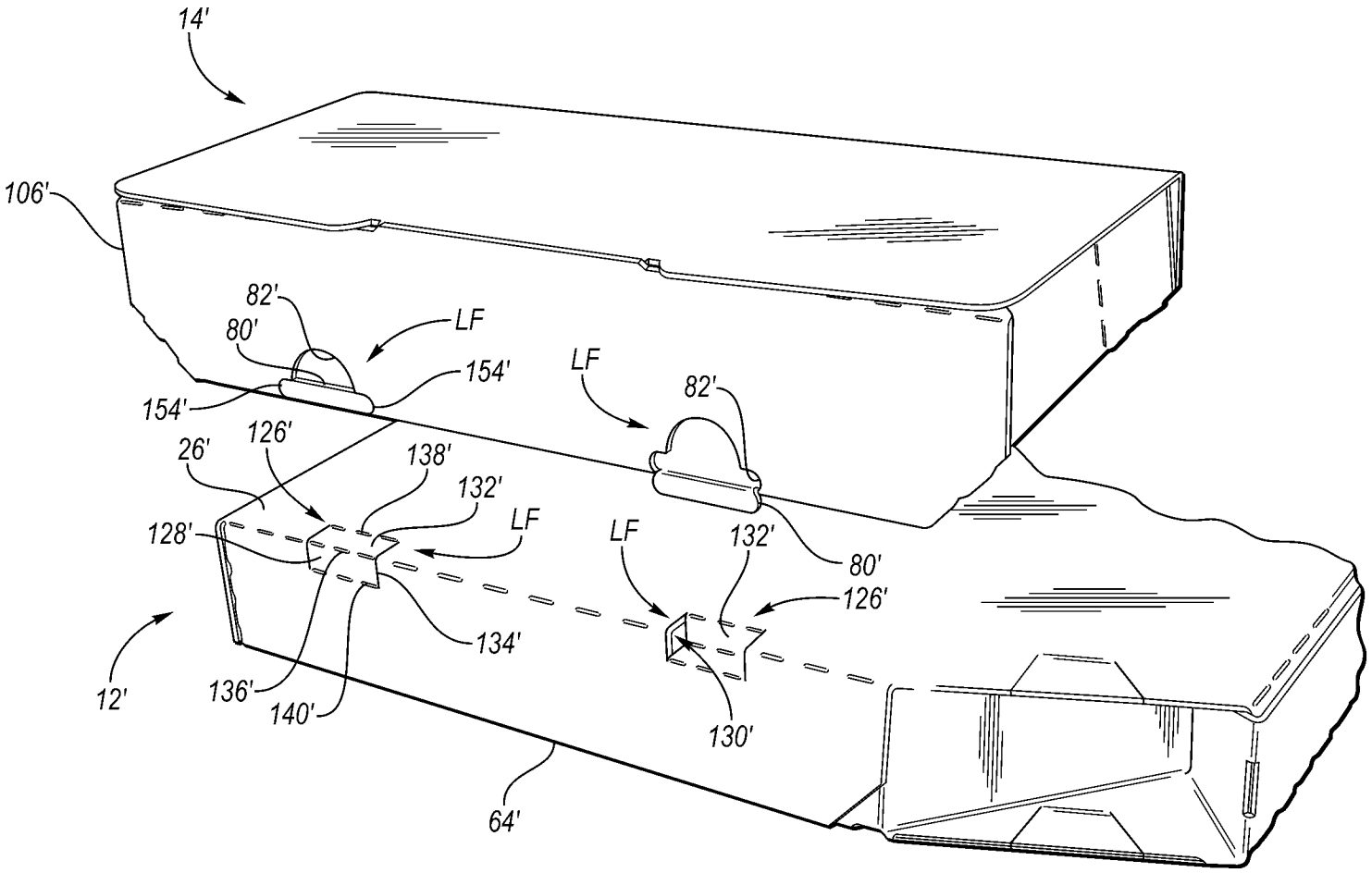
FIG. 8 is a fragmentary perspective view of additional embodiments of a pizza box and side-order box according to the present disclosure.

Referring to FIG. 8, additional embodiments of containers according to the present disclosure are shown. The containers include, for example, second pizza box 12' and first side-order box 14'. The second pizza box 12' and first side-order box 14' respectively have similar configurations as the second pizza box 12 and first side-order box 14 described above, and similar features are identified with similar reference numbers (the reference numbers in FIG. 8, however, include a prime mark). The locations of the link features LF for the second pizza box 12' and first side-order box 14' shown in FIG. 8, however, are switched with respect to the second pizza box 12 and first side-order box 14. In that regard, the first side-order box 14' includes one or more link features LF formed in each of rear side panel 96' (not visible in FIG. 8) and front side panel 106', and each of those link features comprises a bendable tab 80' that is received in a corresponding opening 82'. Specifically, in the embodiment shown in FIG. 8, each side panel 96' and 106' includes a generally flat main portion having two openings 82' that each receive a tab 80', and each tab 80' is bendable downwardly with respect to the main portion from a first or inoperative position, in which the tab 80' is generally coplanar with the main portion, to a second or operative position, as explained below in detail.

The second pizza box 12' has one or more link features LF, such as predefined receiving areas 126', that are each cooperable with a link feature LF of the first side-order box 14' for interlocking or otherwise linking the second pizza box 12' with the first side-order box 14'. Each predefined receiving area 126' may be formed at least partially in top panel 26' and/or one of side panels 64'. For example, each predefined receiving area 126' may include a bendable portion 128' formed at least partially in each of the top panel 26' and one of the side panels 64', and the bendable portion 128' is bendable inwardly to at least partially define an opening 130' for receiving a tab 80'. Specifically, each bendable portion 128' may include first and second sections 132' and 134', respectively, that are foldably connected together along a fold line 136'. Furthermore, each first section 132' may be foldably connected to a main portion of the top panel 26' along a first fold line 138', and each second section 134' may be foldably connected to a main portion of one of the side panels 64' along a second fold line 140'.

Similar to the embodiment shown in FIG. 1, one or more of the tabs 80' may each be bent to an operative position and inserted into a corresponding opening 130' to link together the boxes 12' and 14'. Specifically, one or more of the tabs 80' of the first side-order box 14' may be bent downwardly, and each bent tab 80' may be inserted into a corresponding opening 130' of the second pizza box 12' (the tab 80' and predefined receiving area 126' on the left side of FIG. 8 are each shown in the corresponding inoperative position, and the tab 80' and predefined receiving area 126' on the right side of FIG. 8 are each shown in the corresponding operative position). When the tabs 80' are in the operative positions, each tab 80' extends below the bottom panel 92. Furthermore, when the tabs 80' are inserted into the openings 130', projecting portions such as ears 154' of each tab 80' extend below the main portion of the top panel 26' of the second pizza box 12'.

An insert (not shown) may also be used with each of the above described boxes to facilitate heat retention of food items placed in the boxes. For example, an insert may be placed in the bottom portion of each of the above described boxes, and the insert may be configured to help retain heat of a food item placed in the bottom portion of the box and on the insert. Each insert may have generally the same shape as an interior part of the bottom portion of the corresponding box. Furthermore, each insert may be made of any suitable material and in any suitable manner. For example, each insert may be made of a flat piece of die-cut, double-wall corrugated paperboard.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A box configured to receive a food item and being usable with an additional box that is also configured to receive a food item, the box comprising:

a bottom portion including a bottom panel having a link feature foamed therein; and a top portion hingedly connected to the bottom portion and configured to form a cover, the top portion including a top panel having a link feature formed therein;

wherein the link feature formed in the bottom panel of the bottom portion is cooperable with the additional box to link the two boxes together when the additional box is placed beneath the box, or the link feature of the top portion is cooperable with the additional box to link the two boxes together when the additional box is placed on top of the box;

wherein the bottom portion further comprises a bottom panel section that is connected to the bottom panel along a fold line and foldable with respect to the bottom panel such that the bottom panel section is positionable on top of the bottom panel, the bottom panel section includes a link feature that is positioned proximate the link feature formed in the bottom panel when the bottom panel section is positioned on top of the bottom panel, and the link feature of the bottom panel section is cooperable with the link feature of the bottom panel for linking the box with the additional box when the additional box is placed beneath the box; and wherein at least one of the link features comprises a bendable tab.

2. The box of claim 1 wherein the tab of the at least one link feature has angled side walls.

3. The box of claim 1 wherein the tab of the at least one link feature has a generally trapezoid shape when bent.

4. The box of claim 1 wherein each of the link features comprises a bendable tab.

5. The box of claim 1 wherein at least one of the link features is formed at least partially as an aperture.

6. The box of claim 1 wherein the link feature formed in the bottom panel of the bottom portion comprises a bendable tab formed at an edge of the bottom panel.

7. The box of claim 1 wherein the link feature of the top portion comprises a bendable tab formed at an edge of the top panel.

8. The box of claim 1 wherein the bottom portion further comprises a front panel attached to the bottom panel along a fold line, the front panel having a bendable tab formed therein, and wherein the tab of the front panel is bendable downwardly such that the tab of the front panel extends beneath the bottom panel and is receivable in a slot formed in the additional box when the additional box is placed beneath the box.

9. Stackable boxes for receiving food items, the stackable boxes comprising:

first and second boxes that each have a bottom portion and a top portion hingedly connected to the bottom portion and configured to form a cover, each bottom portion including a bottom panel having a link feature formed therein, and each top portion including a top panel having a link feature formed therein;

wherein the link feature formed in the bottom panel of the bottom portion of the first box is cooperable with the link feature of the top portion of the second box to link the boxes together when the first box is placed on top of the second box, and the link feature of the top portion of the first box is cooperable with the link feature formed in the bottom panel of the bottom portion of the second box to link the boxes together when the second box is placed on top of the first box;

wherein each bottom portion further comprises a bottom panel section that is connected to the respective bottom panel along a fold line and foldable with respect to the bottom panel such that the bottom panel section is positionable on top of the bottom panel, wherein, for each bottom portion, the bottom panel section includes a link feature that is positioned proximate the link feature formed in the bottom panel when the bottom panel section is positioned on top of the bottom panel; and wherein at least one of the link features comprises a bendable tab.

10. The stackable boxes of claim 9 wherein each link feature comprises a bendable tab, and each top panel defines an aperture that is revealable when the corresponding tab is bent, and wherein the aperture of the second box is configured to receive the tab of the bottom panel of the bottom portion of the first box when the first box is placed on top of the second box, and the aperture of the first box is configured to receive the tab of the bottom panel of the bottom portion of the second box when the second box is placed on top of the first box.

11. The stackable boxes of claim 9 wherein each of the link features of each bottom portion comprises a bendable tab, and wherein, for each bottom portion, the tab of the bottom panel section is bendable with the tab of the bottom panel when the bottom panel section is positioned on top of the bottom panel.

12. A foldable, one-piece blank for forming a container that is usable with an additional container, the blank comprising:

a first portion for forming a bottom portion of the container, the first portion including a bottom panel and a front panel attached to the bottom panel along a fold line, the front panel having a bendable tab formed therein; and a second portion hingedly connected to the first portion for forming a top portion of the container;

wherein, when the blank is folded to form the container, the tab of the front panel is bendable downwardly such that the tab of the front panel extends beneath the bottom panel and is receivable in a slot formed in the additional container when the additional container is placed beneath the container.

13. The blank of claim 12 wherein the bottom panel of the first portion has a link feature, and the second portion includes a top panel having a link feature, wherein, when the blank is folded to form the container, the link feature of the second portion is cooperable with the additional container to link the two containers together when the additional container is placed on top of the container, or the link feature of the first portion is cooperable with the additional container to link the two containers together when the additional container is placed beneath the container, and wherein at least one of the link features comprises a bendable tab.

14. The blank of claim 13 wherein the tab of the at least one link feature has angled side walls.

15. The blank of claim 13 wherein the link feature of the first portion comprises a bendable tab that is formed at an edge of the bottom panel.

16. The blank of claim 13 wherein the link feature of the second portion comprises a bendable tab that is formed at an edge of the top panel.

17. The blank of claim 13 wherein at least one of the link features is formed at least partially as an aperture.

18. The blank of claim 13 wherein the first portion further comprises a bottom panel section that is connected to the bottom panel along a fold line and foldable with respect to the bottom panel such that the bottom panel section is positionable on top of the bottom panel, wherein the bottom panel section includes a link feature that is positioned proximate the link feature formed in the bottom panel when the bottom panel section is positioned on top of the bottom panel.

* * * * *